United States Patent [19]

Upton

[11] Patent Number: 4,462,093

[45] Date of Patent: Jul. 24, 1984

[54] SYMMETRICAL SHELL SUPPORT FOR FLEXTENSIONAL TRANSDUCER

[75] Inventor: Ralph G. Upton, Nashua, N.H.

[73] Assignee: Sanders Associates, Inc., Nashua, N.H.

[21] Appl. No.: 392,496

[22] Filed: Jun. 28, 1982

[51] Int. Cl.[3] ..... H04R 17/00

[52] U.S. Cl. ..... 367/165; 367/159; 310/337

[58] Field of Search ..... 367/188, 180, 155, 159, 367/165; 310/334, 337

[56] References Cited

U.S. PATENT DOCUMENTS 3,583,677 6/1971 Phillips ..... 310/334

4,017,824 4/1977 Fife et al. ..... 367/155

*Primary Examiner*—Theodore M. Blum

*Attorney, Agent, or Firm*—Louis Etlinger; Donald A. Streck

[57] ABSTRACT

This invention is a transducer support system that couples the weight of the active portion of a transducer to the transducer's flanges without coupling the dynamic motion of the active portion of the transducer to the transducer's flanges. The foregoing invention may be used in a flextensional transducer to produce a transducer with increased acoustic output and lower frequency.

1 Claim, 3 Drawing Figures

SYMMETRICAL SHELL SUPPORT FOR FLEXTENSIONAL TRANSDUCER

FIELD OF THE INVENTION

This invention relates to underwater communications systems and, more particularly, to flextensional transducers that are used to detect objects under water.

BACKGROUND OF THE INVENTION

Flextensional transducers are a type of transducer that may be used in underwater communications systems, i.e., sonar systems. Flextensional transducers may have wider bandwidths, lower operating frequencies, and higher power handling capabilities than other types of transducers of comparable size and weight.

Prior art flextensional transducers had a flexural outer shell which was usually elliptically shaped, and a piezoelectric ceramic stack of elements (used to excite the shell) which were placed between opposing interior walls across the major axis of the shell. When electrically actuated, the piezoelectric stack expands and contracts, thereby flexing the shell which, in turn, projects acoustic energy into a surrounding medium that is usually water.

Prior art flextensional transducers were relatively small (between 6 and 18 inches long, between 4 and 18 inches across the major axis and between 1½ and 7 inches across the minor axis) and fully assembled, their maximum weight was approximately 80 pounds. Large flextensional transducers are used when it is required that the transducer have a higher power output and/or produce lower frequency signals. High acoustic power outputs and low resonant frequencies increase the range and hence, the utility of the transducer. A higher acoustic power output is generally achieved by designing transducers with a greater piezoelectric ceramic volume. This increased ceramic volume increases the weight of the transducer and some times the size of the transducer. Lower resonant frequencies are achieved by utilizing larger and/or thinner walled shells generally leading to larger and heavier transducers.

As flextensional transducers became larger and heavier, it became more and more difficult to support the transducer's piezoelectric stacks and shell, i.e., the active element, between the opposing interior walls of the flanges. One method provided by the prior art to support the active element involved the use of a neoprene boot or band which surrounded the shell/flange interface. The foregoing method required that the boot or band have sufficient strength to support the weight of the active element. As the transducer became larger and heavier, the boot or band no longer was able to support the active element. To relieve the boot of this excessive load, external tie rods were used. The aforementioned rods were fixed between the flanges to support the booted active element in any orientation. One of the disadvantages of the foregoing was that the interface between the tie rods and boots were subject to rapid erosion due to the acoustic activity at the interface. Another disadvantage of tie rod supports is that the tie rods would degrade the activity of the shell and the rods would be subject to bending moments. Thus, the size and weight of the transducer could not be continually increased by the foregoing method.

SUMMARY OF THE INVENTION

This invention overcomes the disadvantages of the prior art by providing a flextensional transducer support mechanism that may have one or more large and heavy piezoelectric stacks and a large and heavy shell. The foregoing allows the weight of the active assembly (the piezoelectric stack and shell) to be transmitted to the flanges without degrading the acoustic output of the transducer by coupling energy to the flanges or disturbing the watertight integrity provided by the boot. The ability to use larger and/or heavier piezoelectric stacks increases the range in which flextensional transducers may detect objects in the ocean.

The apparatus of this invention accomplishes the foregoing by installing a symmetrically located beam along the longitudinal axis of the active assembly. The beam will be of a size and strength adequate to support the anticipated weight of the piezoelectric ceramic/-shell assembly. When located at the geometric center of the stack or stacks, the beam occupies a point of nil amplitude and therefore contributes structurally, without influencing the electrical and acoustical characteristics of the active assembly. The ends of the beam are rigidly coupled to the interior surface of the flanges thereby transmitting the weight of the entire active assembly to the flanges. Hence, the above load bearing beam/flange design frees the neoprene boot from structural contributions and allows the boot to accomplish its primary function, i.e., supplying a watertight seal so that the transducer may be submerged.

The positioning of a beam or support bar at the center of the ceramic stack or stacks and the coupling of the beam to the flanges transmits a considerable amount of undesirable heat to the water environment. As higher voltages are applied to the stack or stacks to achieve higher power outputs, the ceramic plates that comprise the stack or stacks generate increasing amounts of heat. The center of the ceramic stack is normally at the highest temperature within the transducer. Therefore, the beam is ideally located to remove the maximum amount of heat by conduction to the environment.

Thus, the flextensional transducer support mechanism of this invention achieves the dual benefits of physical transducer support, allowing the boot to serve only as a sealing device, and the conduction of heat to the flanges so that the heat may be dissipated into the water permitting larger and more powerful transducers to be constructed.

It is an object of this invention to supply a flextensional transducer with one or more large and heavy piezoelectric stacks.

Other objects and advantages of this invention will become more apparent as the following description proceeds, which description should be considered together with the accompanying drawings.

DESCRIPTION OF A PREFERRED EMBODIMENT

Figure 1:
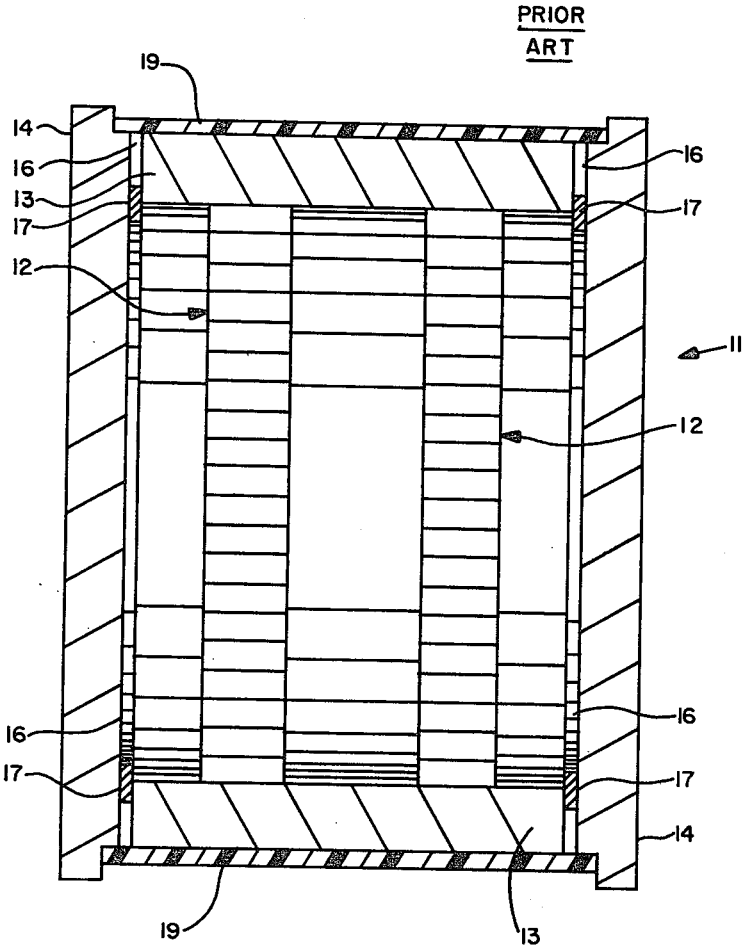
FIG. 1 is a cross-sectional view of a flextensional transducer that was utilized by the prior art.

Referring now to the drawings in detail and more particularly to FIG. 1, the reference character 11 designates a flextensional transducer that was utilized in the prior art. Piezoelectrical ceramic stacks 12 are connected to and compressed by hollow shell 13. Flanges 14 are positioned adjacent to the open ends of shell 13 so that they will preserve a gap 16 between themselves and the ends of shell 13. Discs 17 are located at the ends of shell 13 to preserve the uniformity of gap 16 by centering shell 13 between flanges 14. Flanges 14 are positioned and fixed by external tie rods (not shown). The preservation of gap 16 is vital to the efficient operation of transducer 11, since contact between the ends of shell 13 and flanges 14 will degrade transducer 11 by coupling energy from shell 13 to flanges 14. Elastomeric boot 19 is bonded to the exterior surface of shell 13, as well as to the elliptically shaped portion of flanges 14, to provide a watertight seal bridging gap 16. Thus, the weight of stacks 12 and the shell 13 is supported by boot 19, either alone or nested within external tie rods (not shown). The above arrangement is detrimental to the efficient operation of transducer 11 since some energy is coupled to boot 19, causing a net loss in acoustic output. Furthermore, when stacks 12 increase in size and weight in order to produce lower frequency and higher power transducers, it becomes very difficult, if not impossible, to support stacks 12 because boot 19 will deflect and permit water to enter the transducer. The motion of shell 13, as well as the vibration associated with shipboard and/or structural mounting, will seriously shorten the life of the transducer by eroding the boot and destroying the transducer.

Figure 2:
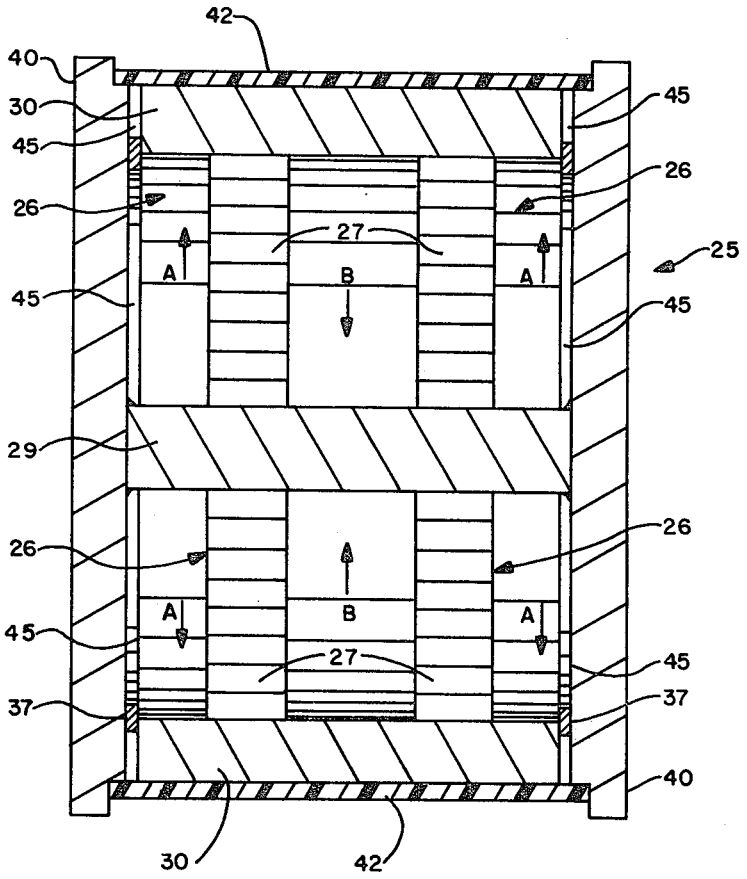
FIG. 2 is a cross-sectional view of a flextensional transducer that utilizes the symmetric shell concept embodied in this invention.

FIG. 2 is a cross-sectional view of a flextensional transducer 25 that may contain many large and heavy piezoelectric stacks whose ends are cemented to the opposite interior walls of hollow shell 30. Only two piezoelectric stacks 26 are shown for purposes of this example since additional piezoelectric stacks may be affixed to transducer 25 in the same manner as stacks 26. Piezoelectric stacks 26 comprise a plurality of ceramic plates 27 which are the same size and are linearly connected together so that the total ceramic motion of piezoelectric stack 26 is the sum of the incremental motions of plates 27. When electrically activated, plates 27 move in the direction shown by arrows A to cause shell 30 to vibrate and the hydrostatic pressure of the ocean will cause shell 30 to move plates 27 in the direction shown by arrow B. Flextensional transducer 25 may also be operated in the passive mode where sound waves that are propagated through the ocean cause plates 27 to move in the direction shown by arrow B and the plates are then discharged and move in the direction shown by arrow A.

Piezoelectric stacks 26 are designed so that there will be the same number of plates 27 on either side of structural support bar 29 and each plate 27 moves with progressively increased amplitude as its distance from bar 29 increases. Thus, bar 29 will be connected to the geometric center or nodal points of stacks 26 (a point where stacks 26 have no motion). Since there is no motion at the nodal points of stacks 26, the connection of bar 29 to stacks 26 will not interfere with the acoustic operation of transducer 25. Support bar 29 bisects the ceramic stacks 26 and is coupled to flanges 40. The center line of stacks 26 is at a position of nil motion (commonly referred to as a nodal position or point). Thus, even though the symmetric support bar 29 is structurally a part of the support system, it does not influence the acoustic system by either contributing to or detracting from the amplitude of displacement of the ceramic stack 26, this amplitude being the same motion that drives the shell 30. Discs 37 are located at the ends of shell 30 to preserve uniformity of the gap 45 by centering shell 30 between flanges 40. Thus, the entire weight of stacks 26 and shell 30 are supported by bar 29, and the end of bar 29 is rigidly coupled to flanges 40 so that flanges 40 will serve as structural supporting members for transducer 25. Flanges 40 may, in turn, be mounted to or attached within any desirable hardware system. Additionally, symmetric support bar 29 serves as a thermal conductor and as such, conducts heat to flanges 40 where the heat is dissipated into the water environment. The foregoing is important since stacks 26 generate heat when electrically driven, and under certain circumstances, this self-generated heat can limit the power output of transducer 25.

By coupling stacks 26 and shell 30 to flanges 40, the weight of stacks 26 and shell 30 will no longer rest on either boot 42 alone, or on boot 42 nested within the tie rods (not shown). Hence, many very large and heavy piezoelectric stacks may be contained within flextensional transducer 25 to achieve lower frequencies and higher power since boots 42 are not used as structural members and the motion of shell 30 is not restricted.

Figure 3:
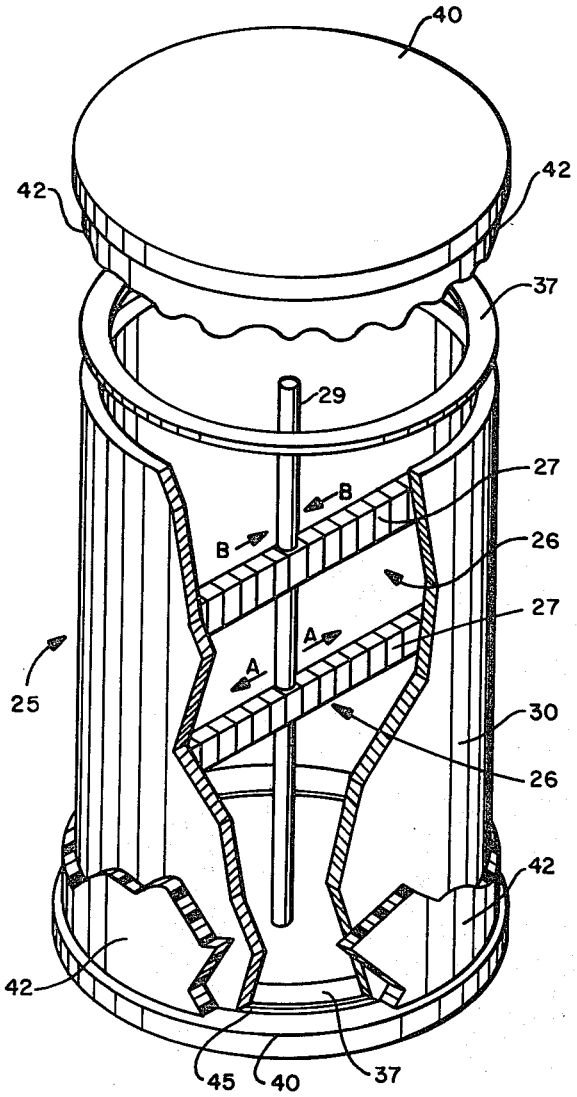
FIG. 3 is a perspective representation of the flextensional transducer shown in FIG. 2.

FIG. 3 is a cutaway perspective representation of transducer 25 which was depicted in FIG. 2. The geometric center of piezoelectric stacks 26 are connected to structural support bar 29 and bar 29 is connected to flanges 40. The ends of piezoelectric stacks 26 (not shown) are cemented to hollow shell 30 and boots 42 are used to cover air gaps 45 and ensure that the inside of transducer 25 is watertight.

The above specification describes a new and improved flextensional transducer that may contain many large and heavy piezoelectric stacks. It is realized that the above description may indicate to those skilled in the art additional ways in which the principles of this invention may be used without departing from its spi it. It is, therefore, intended that this invention be limited only by the scope of the appended claims.

I claim:

1. In a flextensional transducer having a hollow shell which is oval in cross-section and has two open ends, a pair of cover flanges disposed over respective ones of the ends to close the ends with an air gap between the cover flanges and the ends of the shell to allow the transducer to vibrate, a sealing boot disposed over the shell and connecting the cover flanges to seal the transducer, and a stack of driving elements disposed between opposed walls on the inside of the shell for vibrating the shell in response to a signal applied thereto, the improvement to permit higher power operation comprising:

a support and heat conducting bar connected to and between the cover flanges and passing through a nodal point of the stack of driving elements whereby the elements support said bar and said bar supports the cover flanges and the boot is not required to support the cover flanges and additionally heat generated by the stack is conducted by said bar to the cover flanges for dissipation in the surrounding medium while the vibrational characteristics of the transducer are substantially unaffected.

* * * * *